US005865617A

United States Patent [19]

Rappen et al.

[11] Patent Number: 5,865,617

[45] Date of Patent: Feb. 2, 1999

[54] REPLACEABLE NOZZLE FOR HIGH TEMPERATURE REACTORS HAVING A FIRE-RESISTANT LINING

[75] Inventors: Albert Rappen; Peter Jäger, both of Mülheim/Ruhr, Germany

[73] Assignee: VSR Engineering GmbH Fordertechnik, Germany

[21] Appl. No.: 860,607

[22] PCT Filed: Jan. 5, 1996

[86] PCT No.: PCT/EP96/00034

§ 371 Date: Sep. 2, 1997

§ 102(e) Date: Sep. 2, 1997

[87] PCT Pub. No.: WO96/21132

PCT Pub. Date: Jul. 11, 1996

[30] Foreign Application Priority Data

Jan. 5, 1995 [DE] Germany ..... 295 00 061 U

[51] Int. Cl.[6] ..... B05B 1/00

[52] U.S. Cl. ..... 432/103; 239/600

[58] Field of Search ..... 432/2, 75, 103; 239/600, 104, 597

[56] References Cited

U.S. PATENT DOCUMENTS

| | | | |
|---|---|---|---|
| 1,477,517 | 12/1923 | Newberry . | |
| 3,380,407 | 4/1968 | Nilsson . | |
| 3,735,906 | 5/1973 | Zettlemoyer et al. | 222/567 |
| 3,784,107 | 1/1974 | Rossi | 239/600 |
| 3,946,949 | 3/1976 | Rossi | 239/600 |
| 4,240,788 | 12/1980 | Naito et al. | 432/136 |
| 4,373,909 | 2/1983 | Petit et al. | 432/109 |
| 4,451,232 | 5/1984 | Ernst et al. | 432/103 |

FOREIGN PATENT DOCUMENTS

| | | |
|---|---|---|
| 01 97 306 | 10/1986 | European Pat. Off. . |
| 29 52 275 | 7/1981 | Germany . |
| 40 09 301 | 5/1991 | Germany . |

*Primary Examiner*—Teresa J. Walberg
*Assistant Examiner*—Gregory Wilson
*Attorney, Agent, or Firm*—Vickers, Daniels & Young

[57] ABSTRACT

A replaceable nozzle for use in high temperature environments. The nozzle includes a high-temperature-resistant, metal nozzle body that at least partially penetrates into the high temperature environment and a pipe that is connected to the nozzle body for supplying fluid. The nozzle also includes an expansion collar made of a high-temperature-resistant material, a nozzle block and a separating surface or a separating layer of high-temperature-resistant, elastic material. The expansion collar is designed to be disposed between the metal nozzle body and the nozzle block.

59 Claims, 3 Drawing Sheets

REPLACEABLE NOZZLE FOR HIGH TEMPERATURE REACTORS HAVING A FIRE-RESISTANT LINING

The invention relates to the art of replaceable nozzles and more particularly, to replaceable nozzles for high temperature environments.

BACKGROUND OF THE INVENTION

In the related art, fan-angle nozzles (FWD) or fan nozzles are used parallel or perpendicular to the wall that is plastered or surfaced with mortar on the inside of heat exchangers for cement cylindrical rotary kilns. The cakes of cement raw meal that regularly build up are removed by air blasts so that an optimum heat exchange process/material flow is achieved. In addition, the alternative of labor-intensive, high-risk manual removal involving the insertion of air lances or pokers through openings in the heat exchanger wall is avoided. If the mouthpiece of the fan nozzle becomes worn or eroded by chemical reactions, the large-surface cleaning effect decreases. Then, or during regular kiln maintenance, at the latest, the person setting up the heat exchanger must remove the block material and the old nozzle, weld in a new nozzle and fill the hollow chamber with fireproof cement.

SUMMARY OF THE INVENTION

The object of the invention is to provide a replaceable nozzle or a replacement nozzle system that allows nozzles to be replaced easily, particularly cleaning-air blast nozzles, for high-temperature reactors.

This object is accomplished by a replaceable nozzle or a replacement nozzle system such as an angle-fan nozzle for high temperature reactors (i.e. such as heat exchangers of cylindrical rotary kilns for manufacturing cement) that are provided with a fireproof lining. The nozzle comprises a high-temperature-resistant, metal nozzle body that at least partially penetrates the lining of the high-temperature reactor. Preferably, the nozzle includes a slotted outlet gap. The nozzle also includes a pipe that is connected to the nozzle body for supplying fluid. Preferably, the pipe connects to an external air cannon for supplying a blast of cleaning fluid. The nozzle also includes an expansion collar, particularly of elastic, high-temperature-resistant material. Preferably, the expansion collar is approximately 10 mm-thick and made of a ceramic-fiber web or glass-fiber needled felt. The nozzle further includes a nozzle block. The nozzle block is preferably conical toward the outside. The nozzle also includes a separating surface or a separating layer of high-temperature-resistant, elastic material. The expansion collar is disposed between the metal nozzle body and the nozzle block. The nozzle block ends are essentially flush with the inner lining surface and are separated by the separating surface or separating layer from a sheath in the brick lining, particularly from an envelope block, that is preferably conical toward the inside and which corresponds in shape to the nozzle block.

The invention allows the nozzle to be replaced simply from the outside without internal equipment and, possibly, even without complete cooling of the high-temperature reactor or heat exchanger.

A replaceable nozzle according to the invention thus comprises, in addition to the nozzle body that penetrates the reactor wall and the fluid supply pipe connected to the body (in any event, to the extent that a corresponding pipe section penetrates the reactor wall), a nozzle block encompassing the nozzle body along its entire circumference and at least partially along its length, which nozzle block can be inserted into the high-temperature reactor lining by means of its radial side walls so as to fit precisely, with a separating layer that serves as an expansion collar being provided between the nozzle body and the nozzle block, and another separating layer being provided between the nozzle block and the reactor lining adapted to the contour of the nozzle block, which separating layer effects a separation of the nozzle block from the reactor lining in the event of a nozzle replacement.

Whereas the nozzle block is generally manufactured prior to its installation into the reactor wall, and already encompasses the nozzle body, the sheath of the reactor lining into which the nozzle block is snugly inserted can be produced at the manufacturing site, i.e., concurrently with the installation of the nozzle block and the nozzle body, or also be pre-constructed for installation in a correspondingly-sized opening for the reactor lining, for example with the provision of an intermediate mortar layer. A third option for manufacturing the sheath for the fitted reception of the nozzle block involves the manufacture of the sheath concurrently with the manufacture of the reactor lining, as described below.

The nozzle block preferably comprises essentially high-temperature-resistant silicon carbide. The nozzle body, preferably of metal, which is installed in the nozzle block to fit precisely and be protected, is detachable from the nozzle block, that is, oxidations or incrustations that would prevent detachment do not occur. Furthermore, the various materials (material pair of silicon carbide/steel) also permit comparatively simple dismantling after use. Oxidation or incrustation also does not occur between the nozzle block and the sheath into which it is installed; in any case, the nozzle block can be removed, specifically withdrawn, from its sheath after use such that a new unit, comprising a nozzle body and a nozzle block as a replacement package, can be quickly inserted into the sheath.

It is understood that the use of silicon carbide for the nozzle block can be advantageous, regardless of the features of the replaceable nozzle or the replacement nozzle system, respectively. The use of silicon carbide as the nozzle block material is, therefore, also advantageous because it is highly resistant to wear and has a low caking tendency on the surface facing the interior of the reactor.

A reinforcing or mounting frame, such as an angular frame, permits the nozzle body and nozzle block to be easily mounted on the reactor wall, particularly with the use of the flange plate of the invention. Thus, the nozzle block and the metal nozzle body are retained by a flange plate mounted outside of the reactor chamber. This type of frame allows for simple positioning of the flange plate and reinforcing of the opening in the reactor wall, and provides the necessary available surface for assembling the nozzle.

The expansion collar according to the invention serves, on the one hand, as a seal between the nozzle block and the metal nozzle body, and, on the other, to compensate the different thermal expansion coefficients, and preferably comprises approximately 10 mm-thick ceramic-fiber web or glass-fiber needled felt.

In the related art, fan-angle nozzles (FWD) protrude into the reactor chamber with their metal nozzle body. To protect the metal nozzle body from adverse effects from the reactor chamber, a protective block can be provided that encompasses the metal nozzle body up to the outlet opening of the nozzle on the inside of the reactor chamber. To compensate the thermal expansion coefficients, it is advantageous to also provide a separating layer between the protective block and the metal nozzle body.

If the metal nozzle body has corresponding recesses in the direction of the nozzle block, the protective block can extend around the metal nozzle body and be held form-fittingly by the metal nozzle body. Since fan nozzles generally have an essentially downward blow-out direction, the protective block can be configured to be positioned on the metal nozzle body parallel to the reactor chamber wall. The form-fitting contact prevents downward slippage, to the side and toward the middle of the reactor, while gravitational force, and generally the material flow direction in the reactor, prevent upward slippage.

The size of the protective block and the opening in the reactor chamber wall is preferably adapted such that the protective block can be withdrawn, with the nozzle, from the reactor chamber wall.

If the fan nozzle is arranged such that the protective block is not held in position by gravitational force, then suitable geometric relationships of the nozzle block, protective block and envelope block can be selected to create a form-fitting contact between the envelope block and the protective block in the installed position, which prevents slippage of the protective block counter to the positioning direction.

In summary, the invention pertains to a replaceable nozzle, such as an angle-fan nozzle for high-temperature reactors, such as heat exchangers of cylindrical rotary kilns for manufacturing cement, that are provided with a fireproof lining. The nozzle comprises a high-temperature-resistant, metal nozzle body that at least partially penetrates the lining of the high-temperature reactor and preferably has a slotted outlet gap. A pipe is connected to the nozzle body for supplying fluid, preferably for connection to an external air cannon for supplying a blast of cleaning fluid. The nozzle comprises an expansion collar, particularly of elastic, high-temperature-resistant material, preferably of approximately 10 mm-thick ceramic-fiber web or glass-fiber needled felt. A nozzle block is preferably conical toward the outside, and has a separating surface or a separating layer made of high-temperature-resistant, elastic material. The expansion collar is disposed between the metal nozzle body and the nozzle block. The nozzle block ends essentially flush with the inner lining surface and is separated by the separating surface or separating layer from a sheath in the brick lining—particularly from an envelope block—that is preferably conical toward the inside and which corresponds in shape to the nozzle block. Preferably, the expansion collar encompasses the metal nozzle body at least along a closed line. The nozzle block and the metal nozzle body are preferably retained by a flange plate mounted outside of the reactor chamber. Preferably, the flange plate seals a hole in the reactor and is configured such that the nozzle block can be inserted, with the nozzle body, from the outside into the reactor through the hole in the reactor wall. Preferably, the nozzle block can be inserted, with the nozzle body, from the outside into the reactor through a hole in the reactor wall. The nozzle block preferably includes a minimum of three screw assemblies that are adjustable in length and are preferably fixedly connected to the flange plate, particularly for preassembling the nozzle block and the flange plate as a unit, and/or as a withdrawal apparatus for withdrawing the nozzle block from the envelope block. Preferably, the nozzle body is fixedly retained with the flange plate, for example by means of a releasable flange, but preferably fixedly bound by means of an outer ring weld. Preferably, the space between the nozzle block and the flange plate is left open and, following the contour of the nozzle block, this space is filled with insulating wool, fireproof cement or a similar heat insulator. The separating layer between the nozzle block and the envelope block or the sheath consists of a ceramic-fiber paper or web is preferably about 2 to 5 mm thick. Preferably, the envelope block or the sheath is formed by high-temperature mortar. The sheath is preferably formed by an envelope block, preferably annular, whose inner contour corresponds to the shape of the nozzle block and the separating layer encompassing it, and the envelope block is connected to the brick lining directly or by means of high-temperature mortar. The envelope block is preferably anchored to the outer reactor wall, is connected in particular to an angular frame, and is anchored to the outer steel wall by means of the angular frame. Preferably, a molded body that corresponds to the outer shape of the nozzle block with its encompassing separating layer assumes the place of the nozzle block during the bricking and filling of the reactor with high-temperature mortar, so the installation opening for all nozzle blocks can be produced with a single molded body during bricking. Preferably, the flange plate is elastically sealed with respect to the steel wall. The flange plate is preferably pressed against an angular frame, which reinforces the hole in the reactor wall in particular, or against a similar device (reinforcing or mounting frame) by means of connector elements equally distributed at the circumference, such as screw assemblies. Preferably, the nozzle block and, if necessary, the envelope block, are produced in a separate mold, and is or are preferably unseparated. Preferably, the nozzle block essentially comprises high-temperature-resistant silicon carbide. The envelope block preferably has a retaining frame and forms a unit with the reinforcing or mounting frame through the connection, particularly welding, of the retaining frame. Preferably, the mounting or reinforcing frame has a longer leg, with the help of which differences in the wall thickness in the masonry can be compensated by shifting the mounting or reinforcing frame in or out with regard to the steel wall. Setting brackets are preferably provided that can be pivoted beneath the nozzle block after the nozzle block is installed, thus ensuring the positioning of the nozzle block in the envelope block. The retaining means are preferably mounted on the pipe of the nozzle, and ensures the exact positioning and retention of the nozzle block with regard to the nozzle by means of adjusting screws. Preferably, a protective block encompasses the nozzle body up to the outlet opening of the nozzle at the inside of the reactor chamber.

The components to be used in accordance with the invention, which are described above, and claimed and described in conjunction with the specific embodiments, are not subject to any special exception conditions with regard to their size, shape, material selection and technical conception, so the selection criteria known in the respective area of application have unlimited uses.

Further details, features and advantages of the subject of the invention ensue from the following description of the attached drawings, in which preferred embodiments of the nozzles and replacement nozzle systems of the invention are illustrated by way of example.

BRIEF DESCRIPTION OF THE DRAWINGS

Reference may now be made to the drawings, which illustrate various embodiments that the invention may take in physical form and in certain parts and arrangements of parts wherein.

DETAILED DESCRIPTION OF PREFERRED EMBODIMENTS

Figure 2:
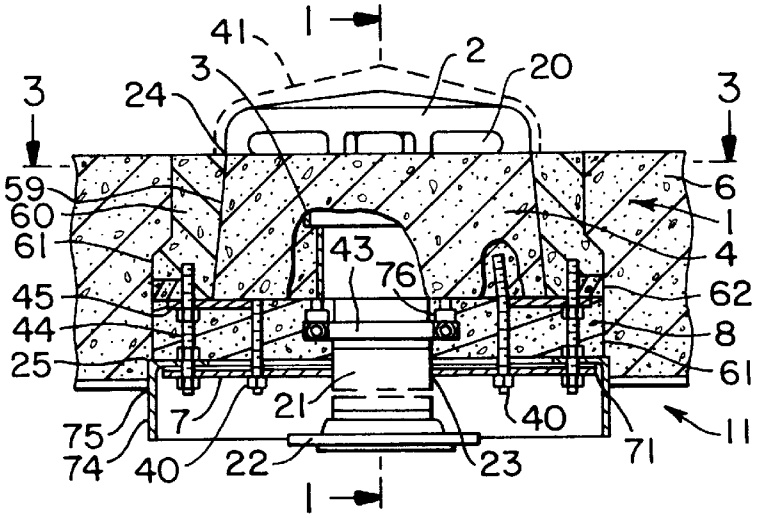
FIG. 2 the same fan-angle nozzle in a sectional view—section along line B—B in accordance with FIGS. 1 and 3.
Figure 3:
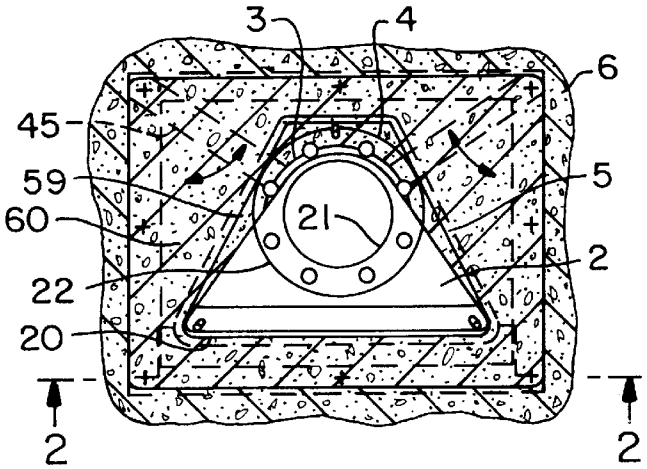
FIG. 3 the same nozzle in top view of the interior of the kiln—partially in section parallel to the kiln wall, along line C—C.

Referring now to the drawings, wherein the showings are for the purpose of illustrating the preferred embodiments of the invention only and not for the purposes of limiting the same, FIGS. 1 through 7 disclose a replaceable nozzle, that is, the entire replacement nozzle system, is indicated by 1. A metal nozzle body 2 is configured as a so-called fan nozzle; in the specific embodiment according to FIGS. 1 through 3, the blow-out direction of the nozzle is through the air-outlet gap 20, tangentially to the brick lining 6 on the interior 10 of the reactor of the reactor wall 11. In the specific embodiments according to FIGS. 4 through 6 and 7, in contrast, the blow-out direction is only sloped slightly with regard to the perpendicular direction of reactor wall 11.

Nozzle body 2 penetrates the lining, i.e., brick lining 6 of reactor wall 11, in the region situated near interior 10 of the reactor, in the specific embodiments illustrated and preferable in this respect. A metal pipe 21 that terminates in a connecting flange 22 at the outside of the reactor adjoins nozzle body 2 at the outside of the reactor, and produces the fluid connection to air-outlet gap 20. Metal nozzle body 2, and at least the region of pipe 21 situated near interior 10 of the reactor, are tightly encompassed by an expansion collar 3. This expansion collar comprises a surrounding band of elastic, high-temperature-resistant material, particularly an approximately 10 mm-thick ceramic-fiber web or a glass-fiber needled felt.

The part of nozzle body 2 and pipe 21 penetrating reactor wall 11 is encompassed form-fittingly, at least in the region near interior 10 of the reactor, by a so-called nozzle block 4 essentially comprising high-temperature-resistant silicon carbide. The radially outwardly-extending surface of nozzle block 4 with regard to nozzle body 2 and pipe 21 forms a layout that is trapezoidal in the specific embodiments according to FIGS. 1 through 3, and square in the embodiments according to FIGS. 4 through 7, preferably having rounded corner regions, with the surfaces that extend radially outward being inclined slightly conically toward each other in the direction of interior 10 of the reactor. In the specific embodiments illustrated and preferable in this regard, these conical, radial outer surfaces are encompassed by a separating layer 5 of high-temperature-resistant, elastic material to ensure a replacement of the nozzle body, including the nozzle block, even after lengthy periods of reactor use such that the structural unit comprising the nozzle body and nozzle block can be withdrawn from reactor wall 11.

The conical, radially outward-extending, encompassing surface of nozzle block 4 and separating layer 5 is seated with full-surface contact in a sheath surface 59 of brick lining 6 such that the end face of nozzle block 4 extending toward interior 10 of the reactor aligns with the remaining inner surface of brick lining 6. In the specific embodiments according to FIGS. 1 through 6, sheath surface 59 is a mating surface of the envelope block 60, which can be installed subsequently in an existing and bricked reactor, as will be explained in detail below. The specific embodiment according to FIG. 7 differs in that, in the specific embodiment according to FIG. 7, envelope block 60 is provided in brick lining 6 from the beginning, or is even constructed as an integral component of brick lining 6 or "in situ" in brick lining 6.

In all of the specific embodiments, the opening in the reactor wall that permits the replacement of the nozzle block, including the nozzle body is encompassed by an angular frame 74, which assumes the function of a reinforcing and/or mounting frame. In the specific embodiments according to FIGS. 1 through 6, this angular frame 74 is inserted into an opening in the metal outer wall of the reactor, the shape of the opening corresponding to the outer contour of the angular frame, such that the angular frame flange, which is parallel to the wall, is displaced inward, parallel to the outer surface of the reactor wall. In contrast, in the specific embodiment according to FIG. 7, the opening in the metal outer wall of the reactor corresponds to the narrow opening of angular frame 74. In both cases, angular frame 74 is fixedly connected to the metal outer wall of the reactor by means of a weld seam 75.

A flange plate 7, which can be fixedly screwed by means of locking screws 73 to the leg of angular frame 74 that is parallel to the wall, supports nozzle body 2 and nozzle block 4 in all of the specific embodiments.

The initial installation of a replaceable nozzle is achieved in the following manner in the specific embodiments according to FIGS. 1 through 3 and 4 through 6:

First, the exact positioning of one or a plurality of nozzles necessary in a reactor is determined, for example to prevent caking at specific points of the reactor. If external reinforcing elements are to be provided on the outer steel jacket of the kiln, in the region provided for the nozzle, they are removed first. Thereupon, a hole is cut in the steel jacket, with angular frame 74 serving as a template for precise dimensioning. The brick lining of the kiln is broken through in the region of the opening in the steel jacket, for example by means of a core bore, and the actual wall thickness of the brick lining is determined at the specified nozzle installation position. Next, the brick lining in the region of the nozzle installation site is removed such that the hole through the wall corresponds to the outer contour of a pre-constructed envelope block 60. This block is preferably stepped or tapered conically toward the interior of the reactor, permitting an installation of the envelope block into the brick lining from the outside with the best possible fit and seating.

The envelope block is provided at its end face, opposite the interior of the kiln, with retaining brackets 61, particularly made of stainless steel, that protrude beyond the block. These retaining brackets 61 can also form an enclosing frame. In the specific embodiments depicted in FIGS. 1 through 6, the depth of envelope block 60 is 180 mm, while the depth of the leg of retaining bracket 61 that protrudes over the block is 70 mm, resulting in a total installation depth of 250 mm. This can also be varied if needed. The objective is for the kiln-side end face of the envelope block to end flush with the reactor brick lining inside. If the masonry in the kiln does not run parallel to the outer steel wall, which can be the case in the lower region of the kiln, for example, then envelope block 60 and/or its retaining frame 61 is lengthened or shortened to meet the requirements for an installation parallel to the brick lining.

For the installation of the envelope block, threaded rods 44 are used, which have been inserted or are inserted into the receptacle or the adjustment bores 62 of envelope block 60, and extend through bores in the flange of angular frame 74 which flange is parallel to the wall. The positioning of envelope block 60 in its insertion direction extending perpendicular to the reactor wall is set by means of threaded rods 44 or threaded nuts that are disposed to be rotatable thereon. Bored-through flat bars serve as so-called setting brackets 45 having a threaded rod 44 extending through each of its bores. These so-called setting brackets 45 can be pivoted about the axis of the threaded rod and serve, among other things, as an assembly aid in the insertion of nozzle block 4, together with nozzle body 2, into the conical opening in envelope block 60.

The legs of envelope-block retaining frame 61, which are oriented transversely to the reactor wall, are dimensioned such that they impact under angular frame 74 and can be welded to the frame by means of longitudinal seams 25. Only after envelope block 60 has been inserted, with envelope-block retainer frame 61 fastened thereto and angular frame 74 welded thereto, into the prepared reactor wall opening is angular frame 74 welded to the steel jacket of reactor wall 11 in the manner described above. Thus, the requirements for installation and subsequent replacement of nozzle block 4 with nozzle body 2 are met. Then, the conical nozzle block circumference is sheathed with ceramic-fiber paper approximately 3 mm thick, which extends along the entire height of the nozzle block. After nozzle body 2 is jacketed with expansion collar 3 at the crucial points, and nozzle body 2 is inserted into nozzle block 4, this unit is inserted into the prepared reactor wall opening, which has been left open by envelope block 60. Prior thereto, however, nozzle block 4 is braced against nozzle body 2. This is achieved by means of a retaining clip 43, which is screwed onto the tubular part of nozzle body 2 and supports nozzle-block straining screws 76, which are stressed against the outer end face of nozzle block 4 until the desired relative position is reached between nozzle body 2, particularly air-outlet gap 20, and the inner end face of nozzle block 4. By means of threaded rods—preferably angled—which are fixedly inserted into the outward-extending nozzle block end face, a nozzle-block screw assembly 40 is achieved with regard to flange plate 7, which holds nozzle body 2 with nozzle block 4. As soon as the desired seating of nozzle block 4 and flange plate 7 is achieved, pipe 21 of nozzle body 2, which extends through a correspondingly-sized bore of flange plate 7, is welded tightly around the circumference to flange plate 7. The unit comprising flange plate 7, nozzle body 2 and envelope block 4 [sic] can then be withdrawn from the hole in the reactor wall, or inserted back into the hole, as needed. An elastic seal 71 is preferably inserted between flange plate 7 and angular frame 74 for sealing and for a releasable connection between flange plate 7 and the leg of angular frame 74 that extends parallel to the wall.

Figure 1:
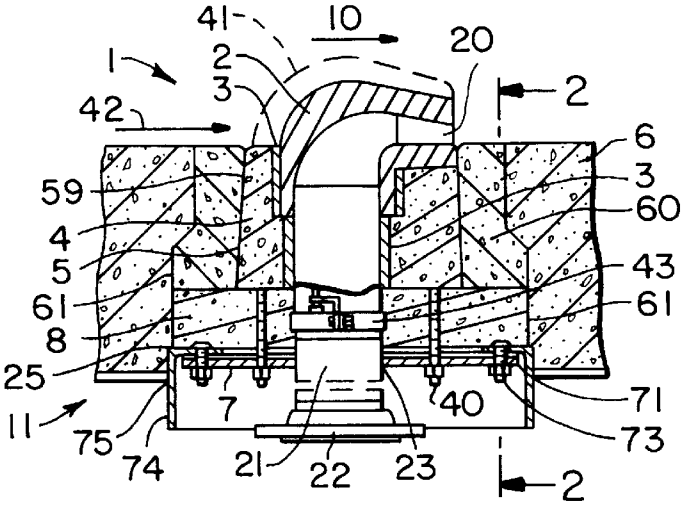
FIG. 1 a first specific embodiment of a replaceable fan-angle nozzle in accordance with the invention, installed in a reactor wall, in an axial section through the nozzle body—section along line A—A, in accordance with FIG. 2.
Figure 5:
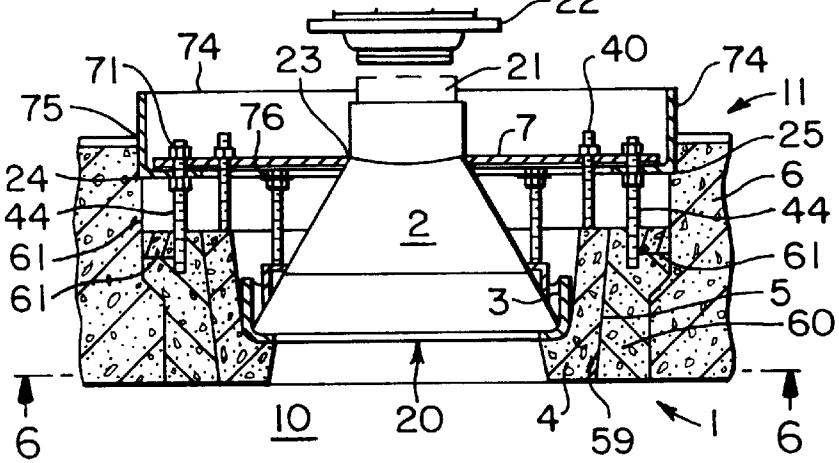
FIG. 5 another sectional view of the same fan nozzle (according to the section in FIG. 2)—section along line B'—B' in accordance with FIGS. 4 and 6.
Figure 6:
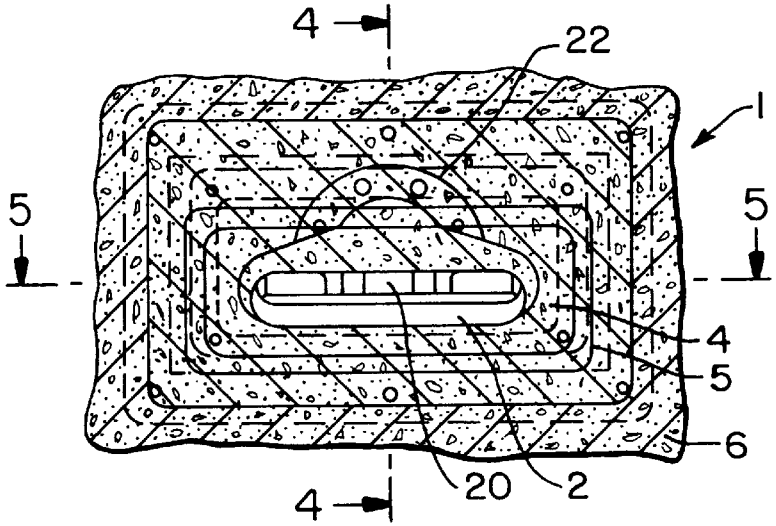
FIG. 6 the same fan nozzle in a section along line C'—C' in accordance with FIGS. 4 and 5 (according to the representation in FIG. 3); as well as FIG. 7 a third specific embodiment of a replaceable fan nozzle in accordance with the illustration in FIG. 5.
Figure 4:
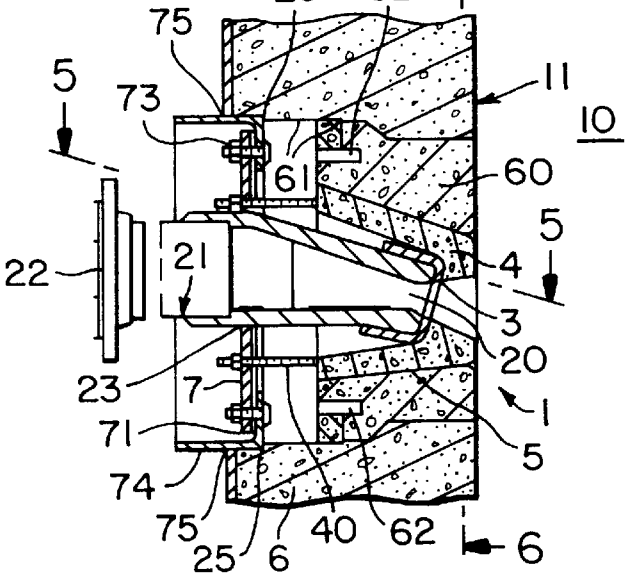
FIG. 4 a second specific embodiment of the fan nozzle according to the invention, depicted as in FIG. 1.

This replacement nozzle system allows defective nozzles to be replaced from the outside with the shortest reactor downtime. It is not necessary to enter the interior of the reactor. The exchange can be accomplished within approximately 1 hour. The open space remaining between flange plate 7 and the outer end face of nozzle block 4 and envelope block 60 can be filled with insulating wool 8 or fireproof cement. This variation is depicted in FIGS. 1 and 2.

In the use of fan-angle nozzles, the nozzle block can also be separated and wrapped in a circumferential band for better assembly.

Figure 7:
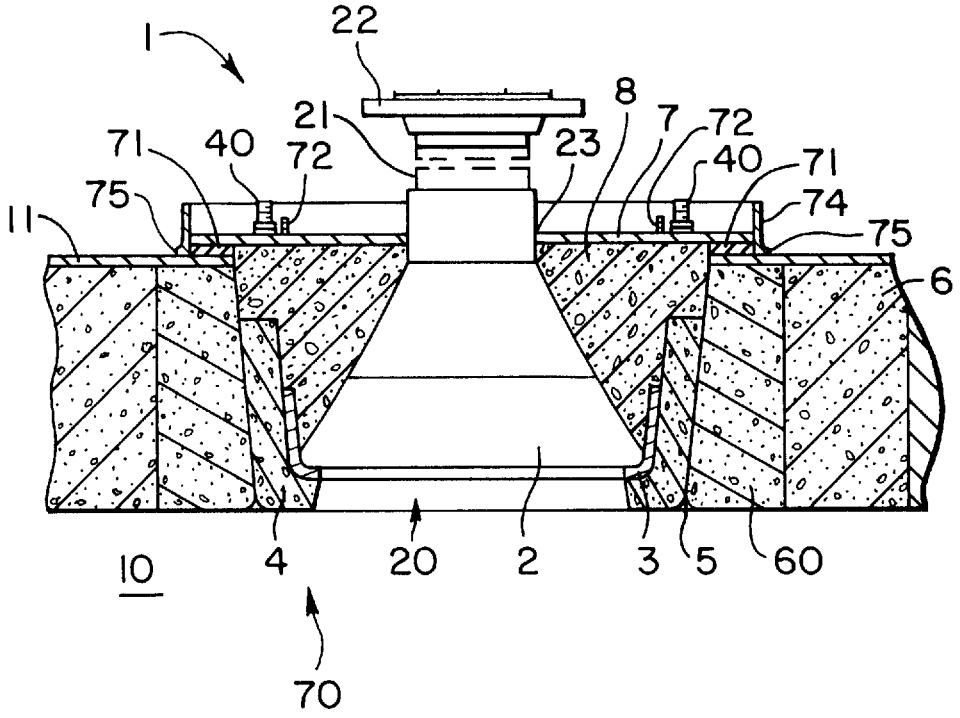

In the specific embodiment according to FIG. 7, envelope block 60 can be prepared by mortaring the hollow space between the nozzle block and the brick lining of the interior of the reactor.

For inspection and replacement purposes, the fan nozzle is dismantled together with the nozzle block and the flange plate. For this, the reactor need not be completely cooled first.

We claim:

1. A replaceable angle-fan nozzle for high-temperature reactors, that are provided with a fireproof lining, the nozzle comprising a high-temperature-resistant, metal nozzle body that at least partially penetrates the lining of the high-temperature reactor, and having a slotted outlet gap, a pipe that is connected to the nozzle body for supplying fluid, and connected to an external air cannon for supplying a blast of cleaning fluid, characterized in that the nozzle comprises an expansion collar, particularly of elastic, high-temperature-resistant material, of about 10 mm-thick ceramic-fiber web or glass-fiber needled felt, a nozzle block that is substantially conical toward the outside, and a separating surface or a separating layer of high-temperature-resistant, elastic material, wherein the expansion collar is disposed between the metal nozzle body and the nozzle block; and the nozzle block ends essentially flush with the inner lining surface, and is separated by the separating sheath surface of an envelope block from the fireproof lining, the envelope block having a substantially conical shaped toward the inside and which corresponds in shape to the nozzle block, the nozzle block with the nozzle body being insertable from the outside into the reactor through a hole in the reactor wall.

2. The nozzle as defined in claim 1, characterized in that the expansion collar encompasses the metal nozzle body at least along a closed line.

3. The nozzle as defined in claim 1, characterized in that the nozzle block and the metal nozzle body are retained by a flange plate mounted outside of the reactor chamber.

4. The nozzle as defined in claim 3, characterized in that the flange plate seals a hole in the reactor that is configured such that the nozzle block can be inserted with the nozzle body, from the outside into the reactor through the hole in the reactor wall.

5. The nozzle as defined in claim 3, characterized in that the nozzle block includes a minimum of three screw assemblies that are adjustable in length and are fixedly connected to the flange plate.

6. The nozzle as defined in claim 3, characterized in that the nozzle body is fixedly retained with the flange plate.

7. The nozzle as defined in claim 3, characterized in that the space between the nozzle block and the flange plate is left open and, following the contour of the nozzle block, this space is filled with a heat insulator.

8. The nozzle as defined in claim 1, characterized in that the separating layer between the nozzle block and the envelope block consists of a ceramic-fiber paper or web that is approximately 2 to 5 mm thick.

9. The nozzle as defined in claim 1, characterized in that the envelope block is formed by high-temperature mortar.

10. The nozzle as defined in claim 1, characterized in that the sheath surface is formed by the envelope block, is substantially annular, whose inner contour corresponds to the shape of the nozzle block and the separating layer encompassing the nozzle block, the envelope block interengaging the fireproof lining.

11. The nozzle as defined in claim 1, characterized in that the envelope block is anchored to the outer reactor wall by an angular frame.

12. The nozzle as defined in claim 1, characterized in that a molded body that corresponds to the outer shape of the nozzle block with its encompassing separating layer assumes the place of the nozzle block during the bricking and filling of the reactor with high-temperature mortar so the installation opening for all the nozzle blocks can be produced with a single molded body during bricking.

13. The nozzle as defined in claim 3, characterized in that the flange plate is elastically sealed with respect to the steel wall.

14. The nozzle as defined in claim 3, characterized in that the flange plate is pressed against an angular frame which reinforces the hole in the reactor wall.

15. The nozzle as defined in claim 1, characterized in that at least one of the nozzle block and the envelope block is produced in a separate mold.

16. The nozzle as defined in claim 1, characterized in that the nozzle block comprises a high-temperature-resistant silicon carbide.

17. The nozzle as defined in claim 1, characterized in that the envelope block has a retaining frame and forms a unit with a mounting frame through the connection of the retaining frame.

18. The nozzle as defined in claim 17, characterized in that the mounting frame has a longer leg, with the help of which differences in the wall thickness in the masonry can be compensated by shifting the mounting frame in or out with regard to the steel wall.

19. The nozzle as defined in claim 1, characterized in that setting brackets are provided that can be pivoted beneath the nozzle block after the nozzle block is installed, thus ensuring the positioning of the nozzle block in the envelope block.

20. The nozzle as defined in claim 1, characterized in that retaining means are mounted on the pipe of the nozzle to position and retain the nozzle block with regard to the nozzle body.

21. The nozzle as defined in claim 1, characterized by a protective block that encompasses the nozzle body up to the outlet opening of the nozzle body at the inside of the reactor chamber.

22. A replaceable nozzle apparatus for a high-temperature reactor with a fireproof lining and a steel outer wall, said apparatus comprising a high-temperature resistant nozzle body having an outer surface, an inner surface, a first opening, and a second opening, and said first opening at least partially penetrating the lining of the reactor; a pipe interengaging with said second opening; a nozzle block having an inner surface and an outer surface wherein said outer surface of said nozzle block includes a taper opening toward the outside of the lining and said inner surface of said nozzle block having a substantially mating shape with said outer surface of said nozzle body; said nozzle block insertable, with said nozzle body, from the outside into the reactor through a hole in the reactor wall; an envelope block having an outer surface and an inner sheath surface wherein said inner sheath surface has a substantially mating shape with said outer surface of said nozzle block.

23. The apparatus as defined in claim 22, wherein said nozzle body is comprised of metal and said first opening includes a slotted outlet gap.

24. The apparatus as defined in claim 22, further comprising an expansion collar disposed between said outer surface of said nozzle body and said inner surface of said nozzle block, a separating layer disposed between said inner sheath surface of said envelope block and said outer surface of said nozzle block.

25. The apparatus as defined in claim 24, wherein said expansion collar is comprised of an elastic, high temperature resistant material.

26. The apparatus as defined in claim 25, wherein said temperature resistant material is at least one of a ceramic-fiber web and a glass-fiber needled felt.

27. The apparatus as defined in claim 24, wherein said expansion collar encompasses said nozzle body at least along a closed line.

28. The apparatus as defined in claim 24, wherein said separating layer comprises at least one of a ceramic-fiber paper and a web that is generally 2 to 5 mm thick.

29. The apparatus as defined in claim 22, wherein said taper of said nozzle block is conical toward the outside.

30. The apparatus as defined in claim 22, wherein said nozzle block and said nozzle body are retained by a flange plate mounted outside of the reactor chamber.

31. The apparatus as defined in claim 30, wherein said flange plate seals said hole in the reactor.

32. The apparatus as defined in claim 30, wherein said nozzle block includes a plurality of screw assemblies that are adjustable in length for interengagement with said flange plate.

33. The apparatus as defined in claim 30, wherein said nozzle body is fixedly retained with said flange plate.

34. The apparatus as defined in claim 30, wherein said apparatus further comprises a space between said nozzle block and said flange plate and said space following said taper of said nozzle block, wherein said space is filled with an insulating material.

35. The apparatus as defined in claim 22, wherein said envelope block is comprised of a high-temperature mortar.

36. The apparatus as defined in claim 22, wherein said sheath surface has an inner contour and said contour corresponding to said outer surface of said nozzle block with a separating layer encompassing it, and said envelope block interengaging the lining.

37. The apparatus as defined in claim 36, wherein said envelope block interengages the outer reactor wall by an angular frame.

38. The apparatus as defined in claim 22, wherein a molded body that corresponds to said outer surface of said nozzle block assumes the place of said nozzle block during the bricking and filling of the reactor with high-temperature mortar, so the installation opening for all nozzle blocks can be produced with a single molded body during bricking.

39. The apparatus as defined in claim 30, wherein said flange plate is elastically sealed with respect to the steel wall.

40. The apparatus as defined in claim 30, wherein said flange plate is pressed against a frame, which reinforces the hole in the reactor wall.

41. The apparatus as defined in claim 22, wherein at least one of said nozzle block and said envelope block are produced in a separate mold.

42. The apparatus as defined in claim 22, wherein said nozzle block is comprised of high-temperature-resistant silicon carbide.

43. The apparatus as defined in claim 36, wherein said envelope block has a retaining frame interengaging a mounting frame.

44. The apparatus as defined in claim 43, characterized in that said mounting frame has a leg, and the length of said leg allowing for differences in the wall thickness in the masonry by shifting said mounting frame in or out with regard to the steel wall.

45. The apparatus as defined in claim 22, wherein setting brackets are provided that can be pivoted beneath said nozzle block after said nozzle block is installed, thus ensuring a positioning of said nozzle block in said sheath surface.

46. The apparatus as defined in claim 22, wherein a plurality of adjustable screws are mounted on said pipe for ensuring positioning and retention of said nozzle block with regard to said nozzle body.

47. The apparatus as defined in claim 22, wherein said apparatus further comprises a protective block that encompasses said nozzle body up to said first opening of said nozzle body at the inside of the reactor lining.

48. The apparatus as defined in claim 22, wherein said taper of said nozzle block is conical toward the outside.

49. The apparatus as defined in claim 48, wherein said nozzle block and said nozzle body are retained by a flange plate mounted outside of the reactor chamber.

50. The apparatus as defined in claim 49, wherein said flange plate seals a hole in the reactor that is configured such that said block can be inserted with said nozzle body, from the outside into the reactor through said hole in the reactor wall.

51. The apparatus as defined in claim 50, wherein said nozzle body is fixedly retained with said flange plate.

52. The apparatus as defined in claim 51, wherein said nozzle block includes a plurality of screw assemblies that are adjustable in length for interengagement with said flange plate.

53. The apparatus as defined in claim 52, wherein said apparatus further comprises a space between said nozzle block and said flange plate and said space following said taper of said nozzle block, wherein said space is filled with an insulating material.

54. The apparatus as defined in claim 53, wherein said flange plate is elastically sealed with respect to the steel wall.

55. The apparatus as defined in claim 54, wherein said sheath surface has an inner contour and said contour corresponding to said outer surface of said nozzle block with a separating layer encompassing it, and said envelope block interengaging the lining.

56. The apparatus as defined in claim 55, wherein said flange plate is pressed against a frame, which reinforces the hole in the reactor wall.

57. The apparatus as defined in claim 56, wherein said envelope block has a retaining frame interengaging a mounting frame.

58. The apparatus as defined in claim 57, characterized in that said mounting frame has a leg, and the length of said leg allowing for differences in the wall thickness in the masonry for by shifting said mounting frame in or out with regard to the steel wall.

59. The apparatus as defined in claim 58, wherein said apparatus further comprises a protective block that encompasses said nozzle body up to said first opening of said nozzle body at the inside of the reactor lining.

* * * * *